United States Patent [19]

Landry

[11] Patent Number: 4,547,700

[45] Date of Patent: Oct. 15, 1985

[54] FLUORESCENT LAMP WITH HOMOGENEOUS DISPERSION OF ALUMINA PARTICLES IN PHOSPHOR LAYER

[75] Inventor: Geraldine A. Landry, Rowley, Mass.

[73] Assignee: GTE Products Corporation, Stamford, Conn.

[21] Appl. No.: 582,676

[22] Filed: Feb. 23, 1984

[51] Int. Cl.[4] ..... H01J 61/46; H01J 61/44

[52] U.S. Cl. ..... 313/487; 313/489

[58] Field of Search ..... 313/486, 487, 489

[56] References Cited

U.S. PATENT DOCUMENTS

| | | | |
|---|---|---|---|
| 2,331,306 | 10/1943 | Casellini | 176/122 |
| 2,386,277 | 10/1945 | Smith | 313/489 |
| 3,067,356 | 12/1962 | Ray | 312/221 |
| 3,514,276 | 5/1970 | Fujio et al. | 65/103 |
| 3,541,377 | 11/1970 | Nagy | 427/106 |
| 3,599,029 | 8/1971 | Martyny | 313/109 |
| 3,748,518 | 7/1973 | Lewis | 313/489 |
| 3,847,643 | 11/1974 | Hammer et al. | 117/33.5 L |
| 3,886,396 | 5/1975 | Hammer et al. | 313/486 |
| 3,887,725 | 6/1975 | Halstead, Jr. et al. | 229/7 R |
| 3,890,530 | 6/1975 | Hammer et al. | 313/489 |
| 3,967,153 | 6/1976 | Milke et al. | 313/489 |
| 3,995,191 | 11/1976 | Kaduk et al. | 313/485 |
| 3,995,192 | 11/1976 | Hammer | 313/489 X |
| 4,058,639 | 11/1977 | Schreurs | 427/67 |
| 4,079,288 | 3/1978 | Maloney et al. | 313/489 |
| 4,431,941 | 2/1984 | Roy et al. | 313/487 |
| 4,451,757 | 5/1984 | Lagos | 313/489 |

FOREIGN PATENT DOCUMENTS

| | | | |
|---|---|---|---|
| 2091936 | 8/1982 | United Kingdom | 313/489 |

*Primary Examiner*—Palmer C. DeMeo

*Attorney, Agent, or Firm*—Carlo S. Bessone; William H. McNeill

[57] ABSTRACT

Lumen maintenance in fluorescent lamps employing plural phosphor layers is improved by including alumina in the second layer; i.e., the layer closest to the discharge.

3 Claims, 2 Drawing Figures

FLUORESCENT LAMP WITH HOMOGENEOUS DISPERSION OF ALUMINA PARTICLES IN PHOSPHOR LAYER

TECHNICAL FIELD

This invention relates to arc discharge lamps which utilize phosphors within the discharge chamber and particularly to such lamps having improved lumen maintenance.

BACKGROUND ART

Arc discharge lamps such as fluorescent lamps which employ a phosphor within a discharge chamber, which chamber also contains an ionizable medium together with mercury vapor, suffer from a gradually decreasing light output as they age. Various factors contribute to the drop-off in light output during operation, and some of these may be caused by deposits of impurities from the cathode; the formation of various compounds of mercury; changes in the phosphor itself; and changes in the glass envelope, particularly where it may be subject to ultraviolet radiation. The ability of such lamps to resist drop-off in light output is generally termed lumen maintenance, and it is measured as the ratio of light output at a given life span compared to an initial light output and expressed as a percentage. Since the light output of a new lamp is apt to vary considerably until it has been in operation for some time, it is usual to start lumen maintenance measurements from some time other than time zero.

While decreasing light output with time is an occurrence for all fluorescent lamps, it is much more of a problem for high output and very high output lamps than it is for normally loaded lamps.

The art and artisians of lamp design have expended much time and money in an effort to solve these problems. Although the problem of lumen maintenance still exists, it has been alleviated to some extent. Many of the solutions proposed involve the employment of refractory metal oxides as protective agents against the hostile environment which exists in arc discharge devices.

For example, U.S. Pat. No. 3,067,356 teaches the use of refractory oxides such as $Al_2O_3$, $SiO_2$ and $TiO_2$ as coatings on the interior glass surface of fluorescent tubes. U.S. Pat. No. 3,514,276 teaches the use of alumina ($Al_2O_3$) as a thermal ray reflecting film. U.S. Pat. No. 3,541,377 teaches the application of an alumina coating to the interior surface of a fluorescent tube through the application of boehmite (AlO(OH)) and subsequent processing. U.S. Pat. No. 3,599,029 teaches the application of a titanium dioxide layer having a layer of aluminum oxide thereover. U.S. Pat. No. 3,748,518 lumen maintenance improvement by doping fluorescent lamp glass with titania and applying a layer of $TiO_2$ thereover by vapor deposition. U.S. Pat. No. 3,847,643 relates to the treatment of fluorescent lamp tubing with aluminum and titanium containing compounds for improving phosphor maintenance. U.S. Pat. No. 3,890,530 relates to two-layer precoats on fluorescent lamp tubing, i.e., a layer of aluminum oxide over a layer of titanium dioxide. U.S. Pat. No. 3,967,153 teaches a fluorescent lamp having an inner, transparent electrically conductive coating thereon having a protective coating of finely powdered aluminum oxide thereover. U.S. Pat. No. 4,058,639 relates to a process of manufacturing fluorescent lamps having alumina coatings on the interior of the glass envelope. U.S. Pat. No. 4,079,288 teaches an ultra-violet reflecting underlayer of alumina particles in fluorescent lamps.

U.S. Pat. No. 2,386,277 teaches a sputtered coating of alumina over a phosphor layer in fluorescent lamps. U.S. Pat. No. 3,886,396 teaches a porous, discontinuous layer of alumina of relatively light weight over a phosphor layer and U.S. Ser. No. 228,865, filed Jan. 27, 1981, and assigned to the assignee of the instant application teaches the application of a relatively heavy layer of alumina over a phosphor layer. U.S. Pat. Nos. 3,995,191 and 3,995,192 also disclose aluminum oxide layers over phosphor layers to improve maintenance.

U.S. Pat. No. 2,331,306 discloses a fluorescent lamp wherein aluminum oxide is mixed with a phosphor to promote adherence to the glass. U.S. Pat. No. 3,887,725 discloses the addition of zinc orthophosphate to a calcium halophosphate phosphor slurry as a means of increasing lumen maintenance.

Recent improvements in fluorescent lighting have included lamps containing multiple layers of different phosphors. Where one of the phosphors has a known, better maintenance than the other, it has been suggested that the former be applied over the latter to at least partially shield the latter from the hostile environment within the lamp.

It would be an advance in the art if a more favorable means could be found for increasing the lumen maintenance of multiple phosphor layer fluorescent lamps.

DISCLOSURE OF THE INVENTION

It is, therefore, an object of the invention to obviate the disadvantages of the prior art.

It is another object of the invention to enhance the operation of fluorescent lamps.

Yet another object of the invention is increased lumen maintenance in multiple phosphor layer fluorescent lamps.

These objects are accomplished, in one aspect of the invention, by the provision of a fluorescent lamp having a light transmissive envelope containing an arc generating and sustaining medium which includes mercury. Electrodes are sealed into the ends of the envelope which has on its interior surface a first layer of a substantially broad-band emitting phosphor. Overlying the first layer is a second layer of phosphor which comprises a mixture of three substantially narrow-band emitting phosphors. Included within the second layer is a substantially homogeneous dispersion of sub-micron size particles of alumina in an amount of from about 6 to 50 percent by weight of the second phosphor layer.

Fluorescent lamps made in accordance with the above exhibit increased lumen maintenance when compared with lamps without the alumina.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
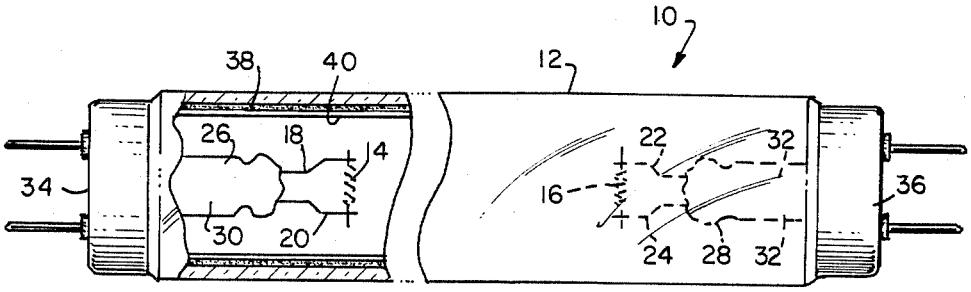
FIG. 1 is an elevational view of a fluorescent lamp, partially in section, illustrating the invention.
Figure 2:
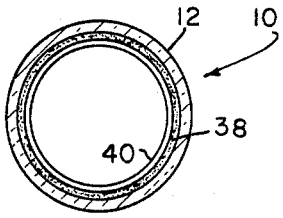
FIG. 2 is a cross-sectional view of the lamp of FIG. 1.

Referring now to the drawings with greater particularity, there is shown in FIG. 1 an arc discharge lamp of the fluorescent type. The lamp 10 is comprised of an elongated glass tube 12 of circular cross-section. It has the usual electrodes 14 and 16 at each end supported by lead-in wires, 18, 20; and 22, 24 respectivley, which extend through glass presses 26, 28 in mount stems 30, 32, to the contacts in bases 34, 36, affixed to the ends of the lamp.

The sealed tube is filled with an inert gas such as argon or a mixture of argon and neon at a low pressure, for example 2 torr, and a small quantity of mercury, at least enough to provide a low vapor pressure of about six microns during operation.

The interior of tube 12 is coated with a first layer of phosphor 38 such, for example, as a calcium halophosphate activated by antimony and manganese.

A phosphor coating suspension was prepared by dispersing the phosphor articles in a water base system employing polyethylene oxide and hydroxyethyl cellulose as the binders with water as the solvent.

The phosphor suspension was applied in the usual manner of causing the suspension to flow down the inner surface of the bulb and allowing the water to evaporate leaving the binder and phosphor particles adhered to the bulb wall.

The first phosphor layer 38 is then overcoated with a second phosphor layer 40 comprised of three substantially narrow-band emitting phosphors.

These three phosphors can be, e.g., a magnesium aluminate activated by cerium and terbium and having a peak emission at 545 nm; an yttrium oxide activated by tri-valent europium and having a peak emission at 611 nm; and a barium magnesium aluminate activated by di-valent europium and having a peak emission of 455 nm. The second layer also includes a substantially homogeneous dispersion of sub-micron size particles of alumina in an amount of from about 6 to about 50 percent by weight of the second phosphor layer. The alumina is available from Degussa, Incorporated and designated as Aluminum Oxide C. This material has a particle size range of 0.01 to 0.04 microns and a surface area of about 100 square meters per gram.

The second phosphor layer 40 containing the alumina is also applied from a water base suspension comprising polyethylene oxide dissolved in water. Suspensions of the three phosphors, were prepared with various concentrations of alumina additions and then applied by allowing the coating to flow down over the first phosphor layer 38 until the phosphor-alumina coating drained from the bottom of the bulb indicating the coverage of the phosphor layer 38 was complete. The double phosphor coated bulbs with the alumina were baked to remove the organic components of the binder and were then processed into fluorescent lamps by conventional lamp manufacturing techniques.

Control lamps were fabricated by identical techniques but had no alumina mixed in the second phosphor layer.

A number of different fluorescent lamp types were evaluated with various alumina concentrations in the second phosphor layer and compared with controls which did not have the alumina addition. The results are summarized in Tables I through III. In all of these Tables, the lumen maintenance is calculated as the ratio of light output at the ending hour relative to the light output at 100 hours. The comparisons have been made on the basis of the 100 hour starting point because of the very rapid drop-off during initial operations which would distort the maintenance figures.

The tests were run by photometering the lamps for light output in a standard photometric sphere, both initially and at the stated times.

The objective of the test reported in Table I was to determine the effect of the alumina addition at a reduced coating weight for the three phosphor layer. The results show a suppression of the 100 hour brightness at the reduced tri-phosphor weight; however, the beneficial effect of the alumina on improving lumen maintenance is evident by 3,000 hours and after of lamp operation since not only is the maintenance better than the control lamps without the alumina but the actual light output is also greater. In fact, at 12,000 hours an exceptional maintenance of close to 90 percent was obtained for this high current loaded lamp type with a brightness superiority of better than 13 percent.

Table II shows the effect of alumina concentration at constant tri-phosphor weight. At the highest concentration of 53.7 percent, the alumina decreased the initial brightness but still resulted in improved maintenance compared to the controls. Moreover, the lower concentrations demonstrated improvements in both the lumen maintenance and light output.

The test results in Table III, with the maximum alumina amount set at 30 percent, gave improved lumen values throughout the lamp burning period in addition to the better maintenance.

Thus, in all cases with the alumina added to the tri-phosphor second layer 40, improved lamps are produced. The same beneficial results were obtained regardless of whether the binder in the first phosphor layer 38 was removed prior to the application of the second layer 40 or a single bake was employed.

TABLE I

| | | | | LAMP TYPE: 58T8/ES Cool White Deluxe | | | | | | |
|---|---|---|---|---|---|---|---|---|---|---|
| SECOND COATING | TRI-PHOS-PHOR WT. GMS. | $Al_2O_3$ WT. GMS. | PER-CENT $Al_2O_3$ | LU-MENS 100 HRS | LUMENS 3,000 HRS | LUMEN MAINTE-NANCE % 100-3,000 HRS | LUMENS 8,000 HRS | LUMEN MAINTE-NANCE % 100-8,000 HRS | LUMENS 12,000 HRS | LUMEN MAINTE-NANCE % 100-12,00 HRS |
| TRI-PHOS-PHOR ONLY | 0.910 | 0 | 0 | 4,911 | 4,396 | 89.5 | 3,872 | 78.8 | 3,687 | 75.1 |
| TRI-PHOS-PHOR & $Al_2O_3$ | 0.324 | 0.256 | 44.1 | 4,658 | 4,499 | 96.6 | 4,275 | 91.8 | 4,182 | 89.8 |

TABLE II

| LAMP TYPE: 96T12 H.O. Lite White Deluxe | | | | | | | | | | |
|---|---|---|---|---|---|---|---|---|---|---|
| SECOND COATING | TRI-PHOS-PHOR WT. GMS. | $Al_2O_3$ WT. GMS. | PER-CENT $Al_2O_3$ | LU-MENS 100 HRS | LUMENS 3,000 HRS | LUMEN MAINTE-NANCE % 100-3,000 HRS | LUMENS 7,000 HRS | LUMEN MAINTE-NANCE % 100-7,000 HRS | LUMENS 9,000 HRS | LUMEN MAINTE-NANCE % 100-9,000 HRS |
| TRI-PHOS-PHOR ONLY | 1.41 | 0 | 0 | 9,408 | 7,976 | 84.8 | 7,519 | 79.9 | 7,300 | 77.6 |
| TRI-PHOS-PHOR & $Al_2O_3$ | 1.36 | 0.34 | 20.0 | 9,470 | 8,403 | 88.7 | 7,997 | 84.4 | 7,746 | 81.8 |
| TRI-PHOS-PHOR & $Al_2O_3$ | 1.43 | 0.56 | 28.1 | 9,559 | 8,551 | 89.5 | 8,031 | 84.0 | 7,755 | 81.1 |
| TRI-PHOS-PHOR & $Al_2O_3$ | 1.59 | 1.02 | 39.1 | 9,390 | 8,541 | 91.0 | 8,139 | 86.7 | 7,948 | 84.6 |
| TRI-PHOS-PHOR & $Al_2O_3$ | 1.44 | 1.67 | 53.7 | 8,878 | 7,936 | 89.4 | 7,536 | 84.9 | 7,287 | 82.1 |

TABLE III

| LAMP TYPE: 40T12 Lite White Deluxe SS34 | | | | | | | | |
|---|---|---|---|---|---|---|---|---|
| SECOND COATING | TRIPHOSPHOR WT. GMS | $Al_2O_3$ WT. GMS | PER-CENT $Al_2O_3$ | LU-MENS 100 HRS | LUMENS 3,000 HRS | LUMEN MAIN-TENANCE % 100-3,000 HRS | LUMENS 6,000 HRS | LUMEN MAINTENANCE % 100-6000 HRS |
| TRIPHOSPHOR ONLY | 0.670 | 0 | 0 | 2,851 | 2,527 | 88.6 | 2,270 | 79.6 |
| TRIPHOSPHOR & $Al_2O_3$ | 0.756 | 0.054 | 6.7 | 2,903 | 2,630 | 90.6 | 2,456 | 84.6 |
| TRIPHOSPHOR & $Al_2O_3$ | 0.805 | 0.115 | 12.5 | 2,879 | 2,623 | 91.1 | 2,430 | 84.4 |
| TRIPHOSPHOR & $Al_2O_3$ | 0.854 | 0.366 | 30.0 | 2,874 | 2,637 | 91.8 | 2,477 | 86.2 |

Scanning Electron Microscope photographs taken of the coated lamps at 500X, 2000X, and 10,000X show the alumina particles covering not only the surface of the tri-phosphor particles in the second layer, but also penetrating down and covering the phosphor particles in the first coating layer.

While there have been shown what are at present considered to be preferred embodiments of the invention, it will be apparent to those skilled in the art that various changes and modifications can be made herein without departing from the scope of the invention as defined by the appended claims.

I claim:

1. In a fluorescent lamp having a light transmissive glass envelope containing an arc generating and sustaining medium including mercury and having electrodes sealed into the ends thereof, said envelope having on its interior a first layer of a substantially broad-band emitting phosphor and a second layer of phosphor comprised of a mixture of three substantially narrow band emitting phosphors, the improvement comprising: said second layer of said phosphor including a substantially homogeneous dispersion of sub-micron size particles of alumina in an amount of from about 6 to about 50 percent by weight of said second phosphor layer.

2. The lamp of claim 1 wherein said alumina comprises about 40 weight percent of said second phosphor layer.

3. The lamp of claim 2 wherein said alumina has a particle size range of from about 0.01 to about 0.04 microns.

* * * * *